US007909113B1

(12) United States Patent
Campos

(10) Patent No.: US 7,909,113 B1
(45) Date of Patent: Mar. 22, 2011

(54) HYDRO-POWERED FIREPLACE SAFETY AND CLEANING SYSTEM

(76) Inventor: German Campos, North Bay Village, FL (US)

( * ) Notice: Subject to any disclaimer, the term of this patent is extended or adjusted under 35 U.S.C. 154(b) by 480 days.

(21) Appl. No.: 12/027,642

(22) Filed: Feb. 7, 2008

(51) Int. Cl.
*A62C 3/00* (2006.01)

(52) U.S. Cl. ..... 169/54; 169/48; 239/16; 239/289; 126/500

(58) Field of Classification Search ..... 169/54, 169/48; 239/16–23, 289; 126/500–555
See application file for complete search history.

(56) References Cited

U.S. PATENT DOCUMENTS 3,889,738 A * 6/1975 Murphy ..... 169/49
4,560,007 A * 12/1985 Molloy et al. ..... 169/54
5,092,312 A * 3/1992 Zolow ..... 126/500
* cited by examiner

*Primary Examiner* — Dinh Q Nguyen
(74) *Attorney, Agent, or Firm* — Kyle Fletcher

(57) ABSTRACT

The invention is a fire place extinguishing and cleaning system which includes a water spray pipe with a plurality of water spray outlets wherein the water spray pipe is connected to a conventional water main and a drain outlet connected to a sewer system. The water spray pipe can extinguish a fire as well as wash the ash from the fireplace and rinse the walls of the fireplace, and whereupon the drain will provide a means to wash away the watered-ash debris. The invention also features a flush control knob which adjusts the flow of water spraying inside the furnace and/or fireplace. An alternative embodiment of the present invention features an upper and lower mounted water spray pipe with a plurality of water spray outlets. Another variation includes an ashtray with a drain, and with or without a pump and tank to re-circulate the water.

12 Claims, 5 Drawing Sheets

HYDRO-POWERED FIREPLACE SAFETY AND CLEANING SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of hydro-powered extinguishing systems, and more specifically, to hydro-powered extinguishing systems designed for use in furnaces or fireplaces. The present invention also relates to the field of hydro-powered cleaning systems, more specifically, for use in furnaces and/or fireplaces.

B. Discussion of the Prior Art

The Fullenwider patent (U.S. Pat. No. 4,363,674) discloses a stove and fireplace cleaning method and apparatus. The Fullenwider patent is characterized by a vacuum system having a specially designed pickup member insertable into a stove, furnace or fireplace. While the Fullenwider patent is similar in utility by providing a means for cleaning a furnace, it's cleaning method is based on a vacuum system. Whereas, the present invention uses water to clean a furnace and gravitational forces to flush the water and debris into a drain.

The Zeritis patent (U.S. Pat. No. 5,560,756) discloses a chimney smoke scrubber for the use with stoves and places. The scrubber system includes a tank holding a charge of water, with flow space above the surface for smoke to pass through. The Zeritis patent uses water to clean a chimney, however, it is designed to used as a chimney cap enclosure. The present invention is designed for placement directly inside the fireplace and uses a water line instead of a tank. Furthermore, the present invention uses a drain assembly that is directly connected to the sewer main. The present invention also differs through the use of a flush control knob to adjust the flow of water, whereas, the Zeritis patent uses a scrubber enclosure.

The Landstrom et al. patent (U.S. Pat. No. 5,511,535) discloses an invention relating to an improved barbecue grill having a means of retarding excessive flames. The Landstrom patent uses a photo-detector that sense light from excessive flames. However, the hydro-spraying system of the Lindstrom patent is not designed to clean a fireplace, and the present invention is not designed to extinguish a fire, but may do as such if needed.

The Oliver patent (U.S. Pat. No. 4,143,817) discloses an automatically controlled residential heating system. The Oliver patent uses a heat exchanger adapted to absorb the heat from the flue gases into a fluid passing through the heat exchanger. The Oliver patent differs, however, because its water system is enclosed in a heat exchanger and does not provide any type of cleaning or extinguishing utility.

The McCarthy et al. patent (U.S. Pat. No. 4,165,993) discloses a method of flue and fireplace cleaning employing a system of spraying an industrial type detergent steam spray through a steam hose and having the soaked debris removed by a vacuum hose. While the McCarthy patent is similar in utility by providing a means for cleaning a furnace, it's cleaning method is based on a vacuum system. The present invention uses water to clean a furnace followed by gravity to flush the water and debris down and into a drain.

The Stenovich patent (U.S. Pat. Des. No. 364,946) discloses an ornamental design for an emissions scrubber for wood burning units. The Stenovich patent differs from the present invention because it employs the uses of an emissions scrubber rather than the spraying type and drain type system of the present invention.

The Fuller patent (U.S. Pat. No. 4,160,441) discloses a fireplace utensil having a gas inlet pipe. The Fuller patent, though similar in the configuration of the piping layout, is designed for an effective system of gas distribution for fueling a fire rather than a system designed for cleaning or extinguishing fireplaces.

BRIEF SUMMARY OF THE INVENTION

The invention is a fire place extinguishing and cleaning system which includes a water spray pipe with a plurality of water spray outlets wherein the water spray pipe is connected to a conventional water main and a drain outlet connected to a sewer system. The water spray pipe can extinguish a fire as well as wash the ash from the fireplace and rinse the walls of the fireplace, and whereupon the drain will provide a means to wash away the watered-ash debris. The invention also features a flush control knob which adjusts the flow of water spraying inside the furnace and/or fireplace. An alternative embodiment of the present invention features an upper and lower mounted water spray pipe with a plurality of water spray outlets. Another variation includes an ashtray with a drain, and with or without a pump and tank to re-circulate the water.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
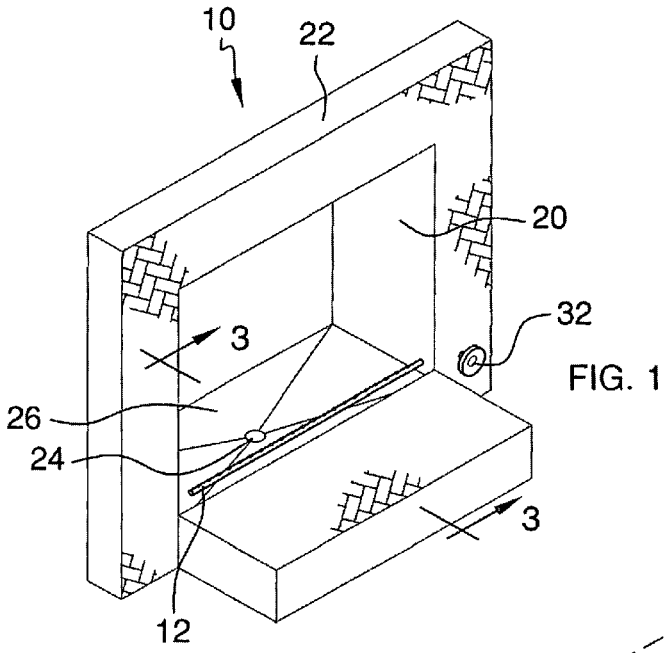
FIG. 1 illustrates an isometric view of the primary embodiment of the invention attached to a fireplace.
Figure 2:
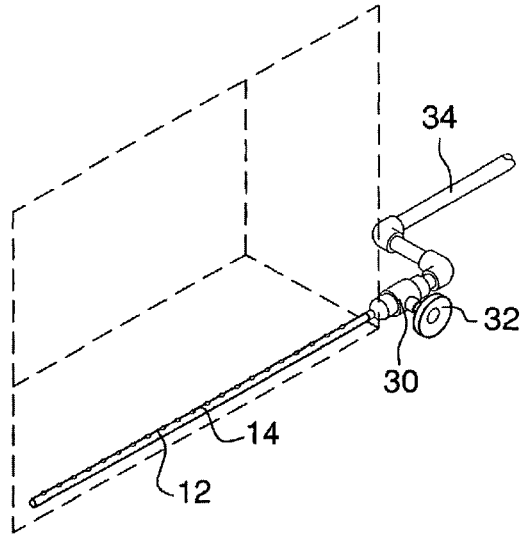
FIG. 2 illustrates a piping diagram of the primary embodiment of the invention.
Figure 3:
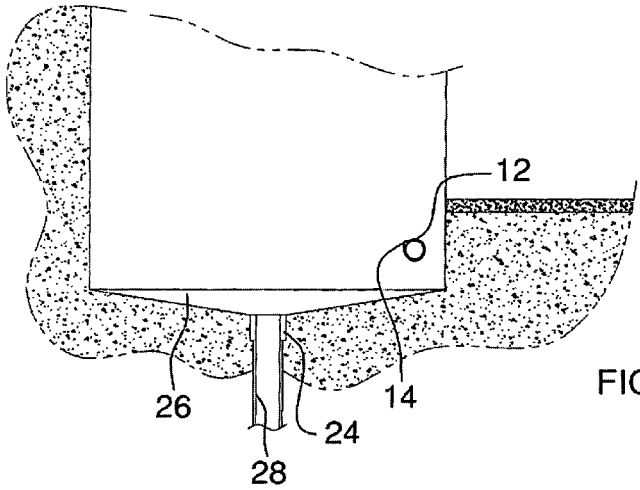
FIG. 3 illustrates a cross-sectional view of the invention along the lines 3-3.

Detailed reference will now be made to the preferred embodiment of the present invention, examples of which are illustrated in FIGS. 1-3 and 5. The invention 10 includes a water spray pipe 12 which has a plurality of jet openings 14 which are designed to spray water 16, over a fire 18. It shall be noted that the jet openings 14 are also designed and aimed to project water 16 onto all interior panels 20 of a fireplace 22.

Once the water 16 is sprayed onto the fire 18 and interior panels 20 of the fireplace 22, the water 16 will remove the debris (not shown) from the interior panels and flow onto a concave bottom center panel 26 and into a main drain 24 of the fireplace 22. The main drain 24 is located at the bottom of the concaved bottom center panel 26 of the fireplace 22 and is attached to a sewer pipe 28.

The water spray pipe 12 is positioned across the exterior opening of the fireplace 22 and travels through an interior panel 20 of the fireplace 22. Once inside the interior panel 20, the water spray pipe 12 is connected to a control valve assembly 30. The control valve assembly 30 has a control valve knob 32 that opens and closes the control valve assembly 30 which in turn regulates the flow of water 16 from the water pipe 34 to the water spray pipe 12. The control valve knob 32 is mounted on an exterior panel 36 of the fireplace 22 and travels through the exterior panel 36 of the fireplace 22 and connects to the control valve assembly 30 which is mounted behind the both the exterior panel 36 and interior panel 20 of the fireplace.

Figure 4:
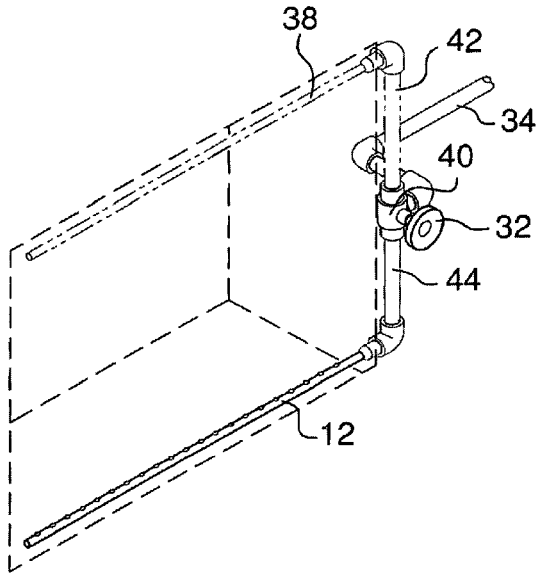
FIG. 4 illustrates a piping diagram of an alternative embodiment of invention.

Referencing FIG. 4, the invention is shown in its alternative embodiment which includes a top water spray pipe 38 and the water spray pipe 12 located along the bottom of the fireplace 22. The top water spray pipe 38 similar to the water spray pipe 12 in that both have a plurality of jet openings 14 which are designed to spray water 16, over the fire 18 of a fire, as well as jet openings 14 that are designed to project water 16 onto the interior panels 20 of the fireplace 22. The top water spray pipe 38 is positioned across the upper exterior opening of the fireplace 22 and travels through an interior panel 20 of the fireplace 22. Once inside the interior panel 20, the top water spray pipe 38 is connected to an upper pipe 42 of a dual outlet control valve assembly 40. Similarly, the water spray pipe 12 is positioned across the lower exterior opening of the fireplace 22 and travels through an interior panel 20 of the fireplace 22. Once inside the interior panel 20, the water spray pipe 12 is connected to the lower pipe 44 of the dual outlet control valve assembly 40.

Figure 5:
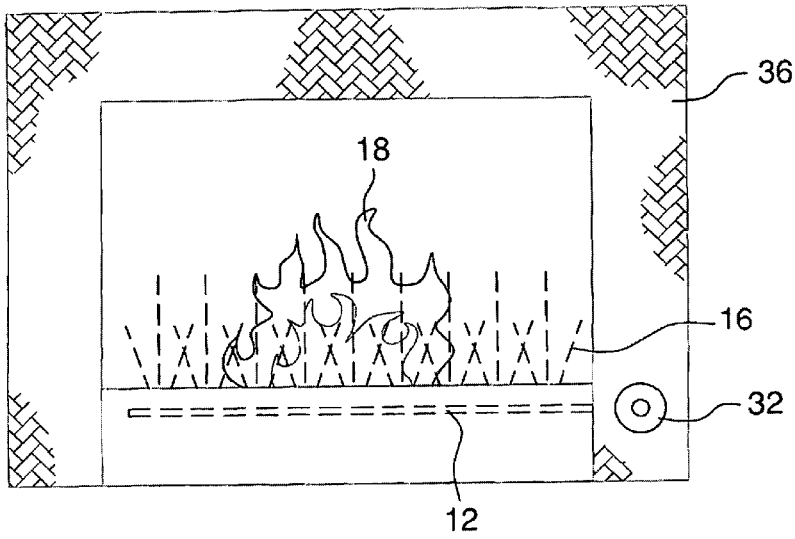
FIG. 5 illustrates a front view of the invention in use.

FIG. 5, depicts the invention 10 in use with the water spray pipe 12 spraying water 16 over the fire and onto the interior panels 20 (not shown) of the fireplace.

The water spray pipe 12, water pipe 34, the top water spray pipe 38, upper pipe 42, and lower pipe 44 are all made of metal tubing that is capable of resisting deformation attributable to heat exposure associated with a typical flame in a fireplace.

Figure 6:
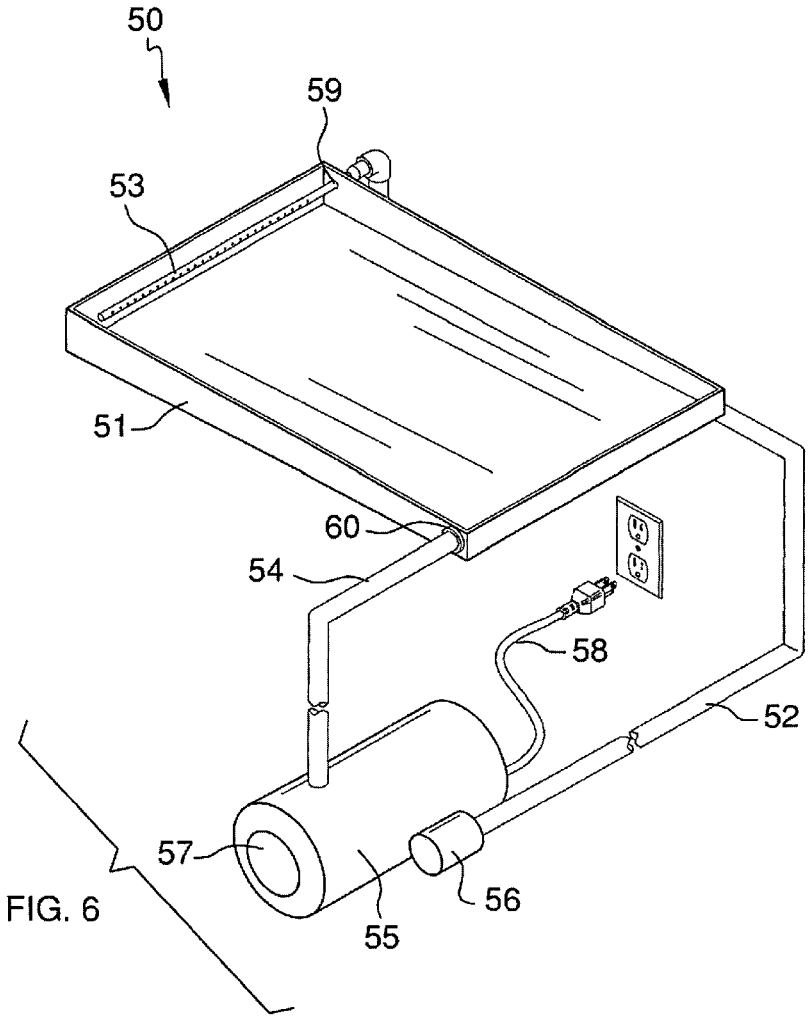
FIG. 6 illustrates an isometric view of an ashtray embodiment with a water re-circulation system.

Referring to FIG. 6, an ashtray embodiment 50 includes an ashtray 51, a water supply line 52, a water spray pipe 53, a drain line 54, a tank 55, and a pump 56.

The tank 55 includes a filter (not shown), which will filter out the ash from the water. The tank 55 includes a compartment 57 for the accumulated ash, and is accessible in order to remove the accumulated ash. The tank 55 also provides a means of storing filtered water. The pump 56 includes an electrical cord 58.

The ashtray 51 includes an inlet port 59 for the water spray pipe 53 to enter, and a drain 60 for connection with the drain line 54. The advent of the ashtray embodiment 50 is to provide an accessory for an existing fireplace.

Figure 7:
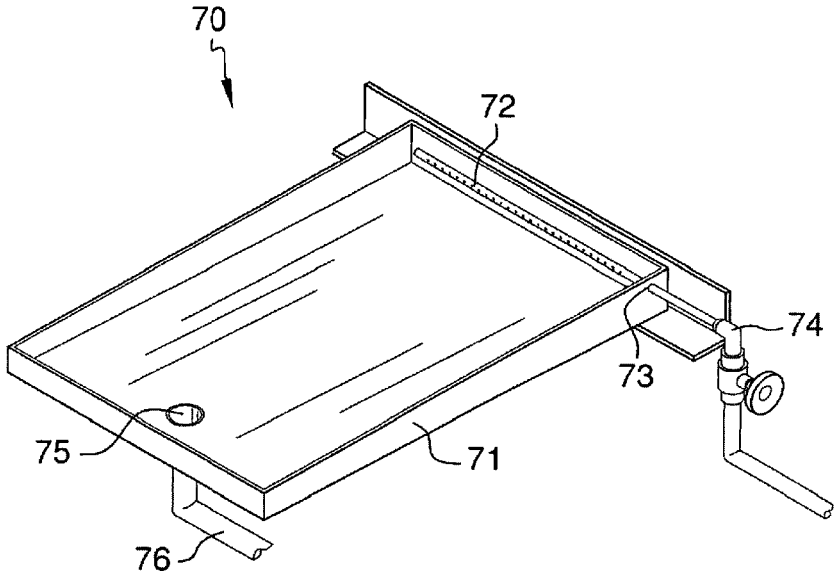
FIG. 7 illustrates an isometric view of an ashtray embodiment without the water re-circulation system.

Referring to FIG. 7, an ashtray embodiment 70 includes an ashtray 71, a water spray pipe 72, an inlet port 73, a water supply line 74, a drain hole 75, and a drain line 76. The function of the ashtray embodiment is analogous to the invention 10 discussed above.

It shall be noted that variations and alternatives of the present embodiment are readily apparent to those of ordinary skill in the art upon reading the present disclosure, and such variations and alternatives including equivalent structures and structural equivalents are incorporated in the invention unless otherwise expressly indicated in the claims.

The invention claimed is:

1. A fireplace extinguishing and cleaning system comprising:

(a) a water spray pipe;

wherein the water spray pipe has a plurality of jet openings that spray water onto a fire and interior panels of a fireplace;

(b) a water supply line;

wherein the water supply line is attached to the water spray pipe;

(c) an ashtray;

wherein the ashtray has a drain;

wherein the drain provides a means of egress for the water used in extinguishing said fire or cleaning of said furnace or fireplace;

wherein said ashtray lies in an existing fireplace and collects ash from a fire;

wherein a drain line is connected to the drain, and delivers water to the re-circulation pump;

wherein the water spray pipe is affixed to a side of said ashtray.

2. The fireplace extinguishing and cleaning system of claim 1 wherein the water supply line, ashtray, and water spray pipe are made of a material comprising plastic or metal.

3. The fireplace extinguishing and cleaning system of claim 1 wherein the water supply line is connected to a re-circulation pump, which is also connected to the drain.

4. The fireplace extinguishing and cleaning system of claim 1 wherein a plurality of water spray pipes are connected to the water supply line.

5. The fireplace extinguishing and cleaning system of claim 1 wherein a tank is connected to the drain line; wherein the tank filters out ash from the water; wherein water exits said tank and is pumped out via the re-circulation pump; wherein the re-circulation pump moves said water into the supply line.

6. The fireplace extinguishing and cleaning system of claim 5 wherein the tank includes a compartment for the accumulated ash.

7. A fireplace extinguishing and cleaning system comprising:

(a) a water spray pipe;

wherein the water spray pipe has a plurality of jet openings that spray water onto a fire and interior panels of a furnace or fireplace;

(b) a water supply line;

wherein the water supply line is attached to the water spray pipe;

(c) an ashtray;

wherein the ashtray has a drain;

wherein the drain provides a means of egress for the water used in extinguishing said fire or cleaning of said furnace or fireplace;

wherein the water supply line is connected to a re-circulation pump, which is also connected to the drain via a drain line;

wherein said ashtray lies in a fireplace and collects ash from a fire.

8. The fireplace extinguishing and cleaning system of claim 7 wherein the water supply line, ashtray, and water spray pipe are made of a material comprising plastic or metal.

9. The fireplace extinguishing and cleaning system of claim 7 wherein a plurality of water spray pipes are connected to the water supply line.

10. The fireplace extinguishing and cleaning system of claim 7 wherein the water spray pipe is affixed to a side, of said ashtray.

11. The fireplace extinguishing and cleaning system of claim 7 wherein a tank is connected to the drain line; wherein the tank filters out ash from the water; wherein water exits said tank and is pumped out via the re-circulation pump; wherein the re-circulation pump moves said water into the supply line.

12. The fireplace extinguishing and cleaning system of claim 7 wherein the tank includes a compartment for the accumulated ash.

* * * * *